US006107969A

United States Patent [19]

Gulino et al.

[11] Patent Number: 6,107,969

[45] Date of Patent: Aug. 22, 2000

[54] TELESCOPING ANTENNA MECHANISM

[75] Inventors: Ronald Gulino, Atlanta, Ga.; Pamela L. Martin, San Diego, Calif.

[73] Assignee: Qualcomm Incorporated, San Diego, Calif.

[21] Appl. No.: 09/153,972

[22] Filed: Sep. 16, 1998

Related U.S. Application Data

[60] Provisional application No. 60/059,127, Sep. 17, 1997.

[51] Int. Cl.[7] ..... H01Q 1/24

[52] U.S. Cl. ..... 343/702; 343/901; 343/903

[58] Field of Search ..... 343/702, 900, 343/901, 903, 715, 883, 882; 455/90; H01Q 1/24, 1/10, 1/12

[56] References Cited

U.S. PATENT DOCUMENTS

| | | | |
|---|---|---|---|
| 4,633,266 | 12/1986 | Alf et al. | 343/903 |
| 5,166,695 | 11/1992 | Chan et al. | 343/702 |
| 5,448,251 | 9/1995 | Gerszberg et al. | 343/702 |
| 5,714,958 | 2/1998 | Rudisill | 343/702 |
| 5,907,306 | 5/1999 | Karabinis et al. | 343/702 |

FOREIGN PATENT DOCUMENTS

| | | | |
|---|---|---|---|
| 0703691 | 3/1996 | European Pat. Off. | H04M 1/02 |
| 2280788 | 2/1995 | United Kingdom | H01Q 1/10 |
| 2289990 | 12/1995 | United Kingdom | H01Q 1/24 |
| 9713290 | 4/1997 | WIPO | H01Q 1/24 |
| 9745891 | 12/1997 | WIPO | H01Q 1/10 |

*Primary Examiner*—Hoanganh Le
*Attorney, Agent, or Firm*—Philip R. Wadsworth; Gregory D. Ogrod

[57] ABSTRACT

A wireless device has a main housing and an antenna housing rotatably mounted on the main housing for rotation between a first, stored position alongside the main housing and at least one operative position. The antenna housing has a tubular extension projecting away from the first axis. A telescoping antenna element is slidably mounted in the tubular extension for telescoping movement between a retracted position and a deployed position extending out of the tubular extension as the antenna housing rotates between the first and operative positions. A flexible member secures the antenna to a rotatable actuator within the antenna housing for pushing the antenna element back and forth between its two positions as the antenna housing is rotated.

16 Claims, 5 Drawing Sheets

2/5

15
22
74
80
65
66
58
38

38
66
65
22
80
74
75

74
22
66
65
66
38
65
80

TELESCOPING ANTENNA MECHANISM

This application claims benefit of Provisional application Ser. No. 60/059,127, filed Sep. 17, 1997.

BACKGROUND OF THE INVENTION

The present invention relates to antennas and more particularly to a technique for stowing an antenna in a reduced volume while automatically deploying the antenna to a desired length during activation of a wireless device.

Many contemporary communications and navigation products have been developed that rely on earth-orbiting satellites to provide necessary communications and navigation signals. Examples of such products include satellite navigation systems, satellite tracking and locator systems, and communications systems which rely on satellites to relay the communications signals from one station to another. Such satellites can form part of various types of known satellite constellations and operate at various orbital altitudes, such as Low Earth Orbit (LEO), Medium Earth Orbit (MEO), or in geosynchronous orbit.

Advances in electronics in the areas of packaging, power consumption, miniaturization, and production, have generally resulted in the availability of such products in a portable package at a price point that is attractive for many commercial and individual consumers. However, one area in which further development is needed is the antenna used to provide communications with satellites. Typically, antennas suitable for use in the appropriate frequency range are larger than would be desired for use with a portable device. Often times, the antennas are implemented using microstrip technology. However, in such antennas, the feed networks are often larger than would be desired or exhibit unwanted characteristics.

Additionally, in applications where transmit and receive communications occur at different frequencies, dual-band antennas are often available only in less than desirable configurations. For example, one way in which a dual band antenna can be made is to stack two single-band quadrifilar helix antennas end-to-end, so that they form a single, common axis cylinder. A disadvantage of this solution, however, is that such an antenna is longer than would otherwise be desired for portable, or hand-held applications.

Another technique for providing dual-band performance has been to utilize two single band antennas, one tuned for each frequency. However, for hand-held units, the two antennas would have to be located in close proximity to one another. Unfortunately, two single band antennas, placed in close proximity on a portable, or hand-held device, create a bulky and unaesthetic unit, which is also undesirable. At the same time, when using satellite repeaters for signal transfer, the communications signals are circularly polarized, or become so through interaction with the atmosphere, and an antenna having good circular polarization is desired.

It has been discovered that antenna structures can be mounted on base support structures that rotate or bases that fold or "flip" the antenna into a deployed position above the telephone. However, such structures still consume more space than is desired, due in part to the length of the antenna elements, and provide complicated mechanical structures across which electrical connections to the antenna elements must be completed.

What is needed therefore, is an antenna in a small enough package such that it is suitable for portable and/or hand-held applications. It is also desirable that the feed structure for the antenna be reduced to a single input connection for many applications.

SUMMARY OF THE INVENTION

It is an object of the present invention to provide a new and improved deployable antenna mechanism for a wireless device such as a portable phone.

According to the present invention, a wireless device is provided comprising a first, wireless device housing, a second, antenna housing rotatably mounted on the first housing for rotation about a first axis between a storage position alongside the first housing and at least one deployed position at an angle to the first housing, the antenna housing having a main body portion rotatably mounted on the first housing about the first axis, and a tubular extension projecting from the main body portion, a telescoping antenna element slidably mounted in the tubular extension for telescoping movement between a retracted position within the tubular extension and an extended position extending out of the tubular extension, a flexible member, preferably in the form of a flexible tape, having a first end secured to the antenna element and a second end in the second housing, the second end of the flexible member being linked to the first housing as the second housing rotates between the storage position and the deployed position, whereby the member or tape pushes the antenna element out of the tubular extension into the extended position as the tubular extension rotates with the second housing about the first axis into the deployed position.

In a preferred embodiment of the invention, the wireless device is a portable phone and there are two deployed positions of the second housing, one for right handed users and one for left handed users, at different angles to the longitudinal axis of the phone housing. In this embodiment, a telescoping ring is rotatably mounted in the second housing for rotation about the first axis, and has a cam or tab which is retained in a detent in a surface of the phone housing as the second housing is rotated between the storage and a first of the two deployed positions, to prevent rotation of the telescoping ring during this movement. The second end of the tape is secured to the telescoping ring so that it is extended upon movement of the second housing from the storage position to the first deployed position. A detent ring is preferably also rotatably mounted in the second housing for rotation about the first axis, and is connected to the second housing so that the second housing and detent ring rotate together. The detent ring has a tab which engages the cam on the telescoping ring when the second housing reaches the first deployed position, pushing the cam out of the detent and causing the telescoping ring to rotate with the second housing during rotation between the first and second deployed positions. The deployed antenna element is, therefore, fixed in the extended position during rotation between the first and second deployed positions of the antenna housing.

When the antenna housing is rotated back from the second deployed position to the storage position, the telescoping ring and antenna element are first linked to the detent ring so as to rotate with the antenna housing. When the antenna housing reaches the first deployed position, the cam on the telescoping ring will again engage in the detent on the first housing so that the telescoping ring and antenna element are held in position while the antenna housing continues to rotate, causing the antenna element to be retracted back into the tubular extension.

Preferably, the first or phone housing has a raised boss surrounding the first axis and extending into the second or antenna housing, and a series of detents are provided around the boss. A first detent corresponds to the storage position of the antenna housing, a second detent corresponds to the first deployed position, and a third detent corresponds to the second deployed position. Preferably, the detent ring has a tab which releasably engages the respective detents to hold the antenna housing in each of the three positions. The cam on the telescoping ring releasably engages the third detent while the antenna housing is in the storage or first deployed positions, or is rotated back and forth between these positions.

Preferably, the antenna element is connected to RF circuitry within the phone housing by means of a pair of RF cables which are coiled within the antenna housing in a clockspring arrangement to provide a feed structure to and from the antenna element.

The telescoping antenna mechanism of this invention provides a relatively simple mechanical structure for deploying the antenna element, allowing the overall length to be reduced when the antenna element is stored, and providing for easy deployment simply by rotating the antenna housing into a convenient orientation relative to the main phone housing. The antenna housing is a small enough package to be suitable for portable or other hand-held applications.

BRIEF DESCRIPTION OF THE DRAWINGS

The present invention will be better understood from the following detailed description of a preferred embodiment of the invention, taken in conjunction with the accompanying drawings in which like reference numerals refer to parts and in which.

DESCRIPTION OF THE PREFERRED EMBODIMENT

Figure 3A:
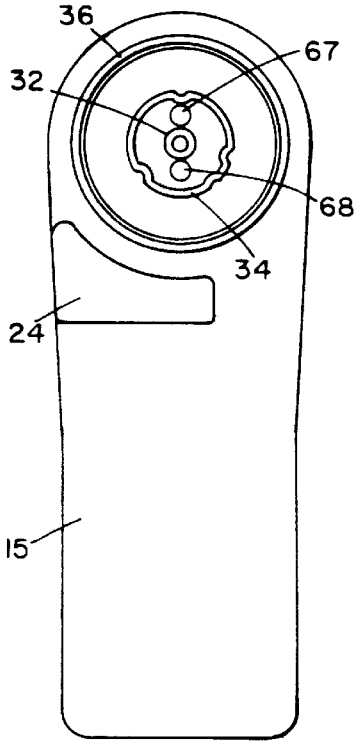
FIGS. 3A to 3G illustrate sequential steps in the assembly of the antenna mechanism onto the back of the phone housing.
Figure 3B:
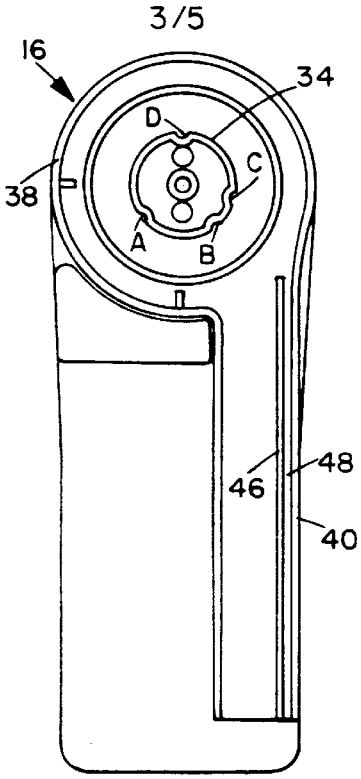
Figure 3C:
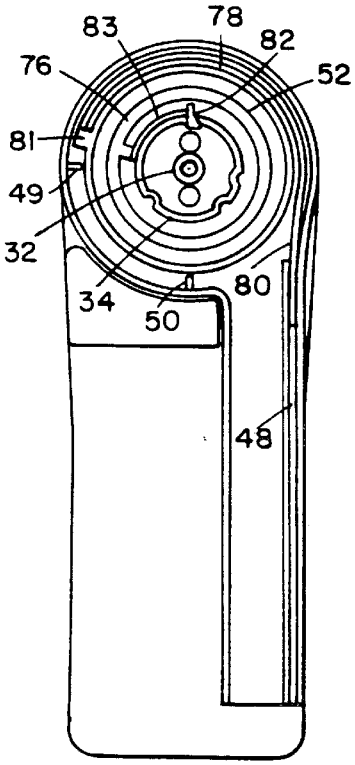
Figure 3D:
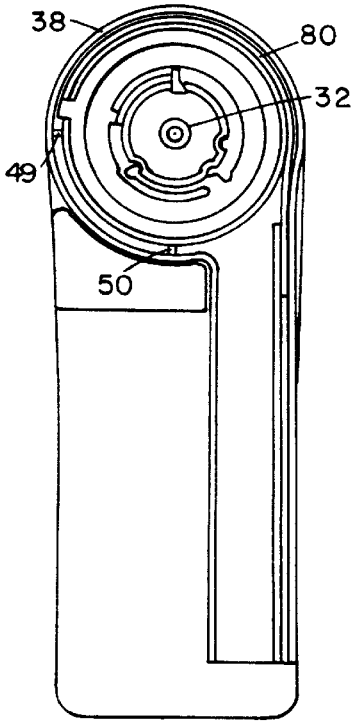
Figure 3E:
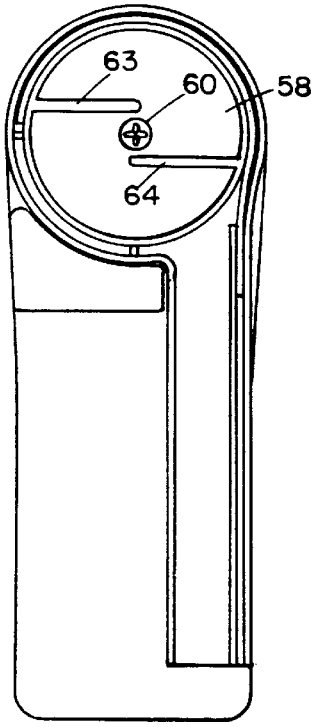
Figure 3F:
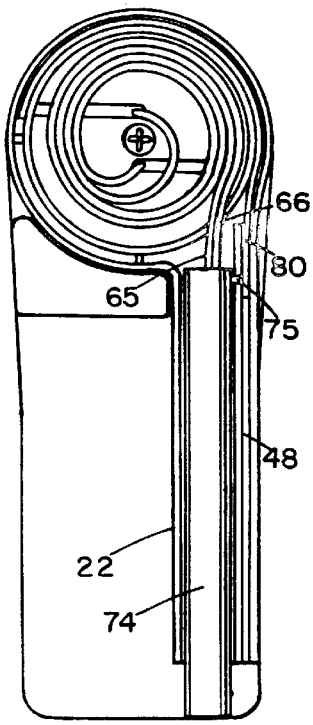
Figure 3G:
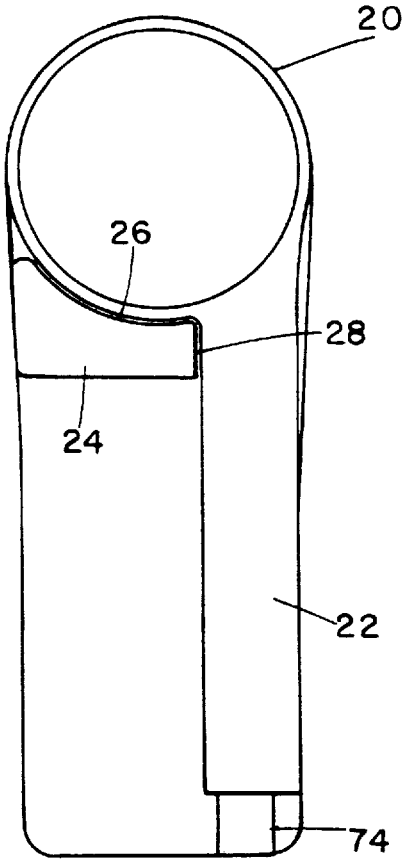
Figure 4:
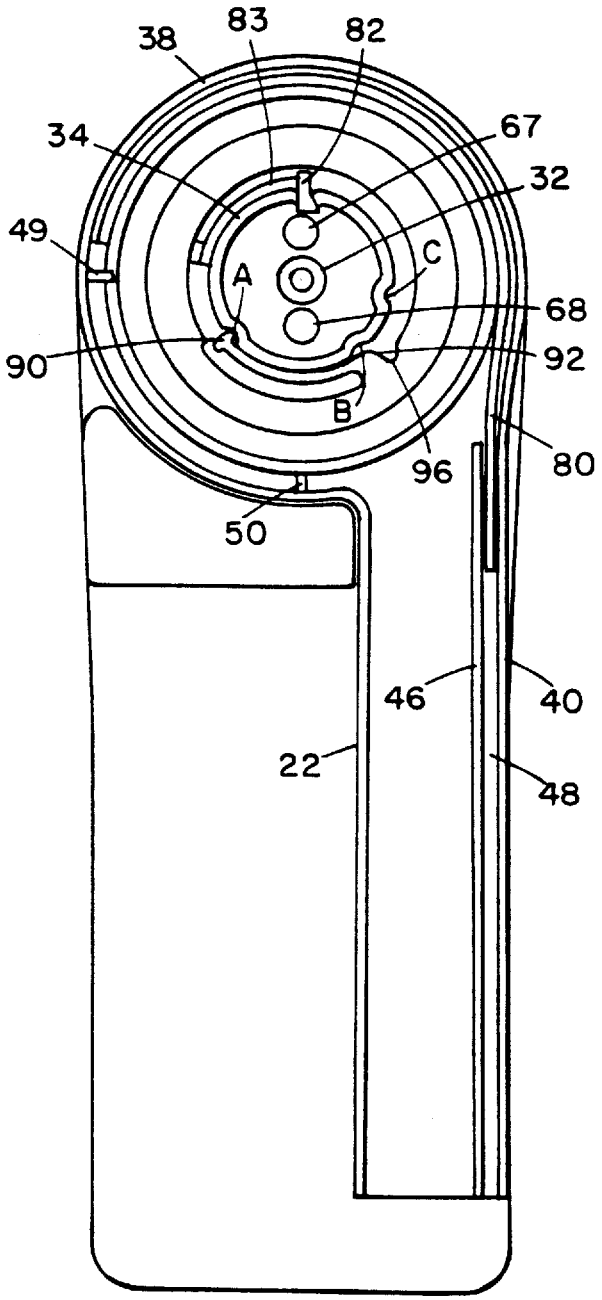
FIGS. 4 and 4A are enlarged plan views illustrating details of the telescoping ring and detent mechanism.
Figure 4A:
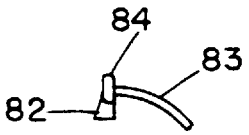
Figures 5A, 5B, 5C:
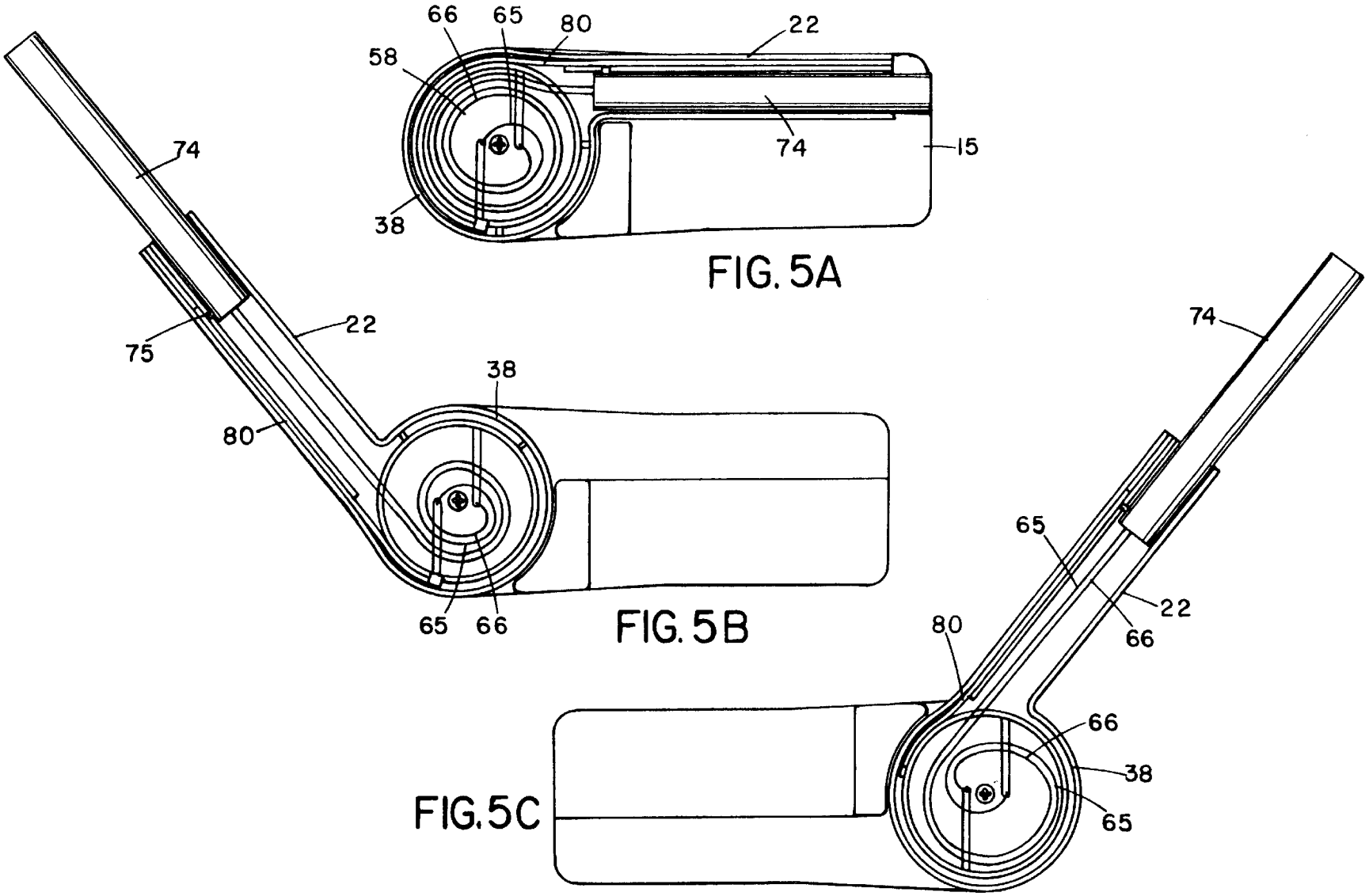
FIG. 5A is a top plan view of the telescoping antenna mechanism with the antenna housing cover removed to show the antenna cable management with the antenna in the storage position.
FIG. 5B is a top plan view similar to FIG. 5A but illustrating the antenna housing in a first rotated or deployed position.
FIG. 5C is a top plan view similar to FIGS. 5A and 5B but illustrating the antenna housing in a second rotated or deployed position.

FIGS. 1 to 5 illustrate a wireless device or portable phone 10 according to a preferred embodiment of the present invention comprising a phone main housing 12 incorporating conventional portable phone circuitry and components (not illustrated), and an antenna housing 14 rotatably mounted on the rear face 15 of the phone housing for rotation between a storage position as illustrated in FIG. 5A and two different deployed positions at different angles to the phone housing, as illustrated in FIGS. 5B and 5C, respectively. The positions of FIGS. 5B and 5C are designed for right-handed and left-handed users, respectively.

Figure 1B:
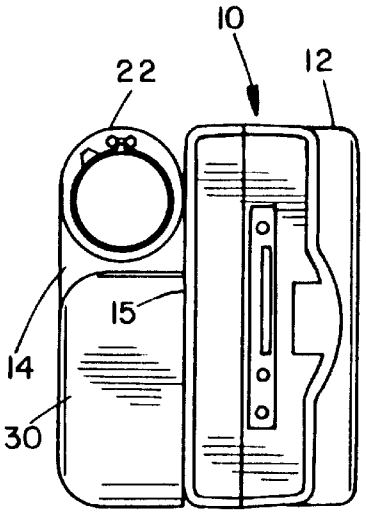
FIG. 1B is an end elevational view of the phone of FIG. 1.
Figure 1:
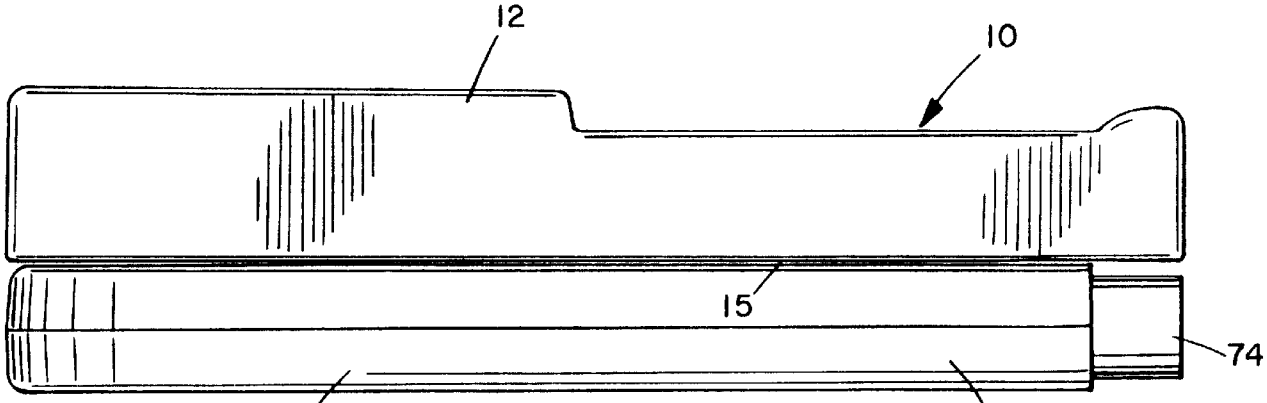
FIG. 1 is a side elevational view of a portable phone with a rotatable antenna mechanism according to a preferred embodiment of the present invention.
Figure 1A:
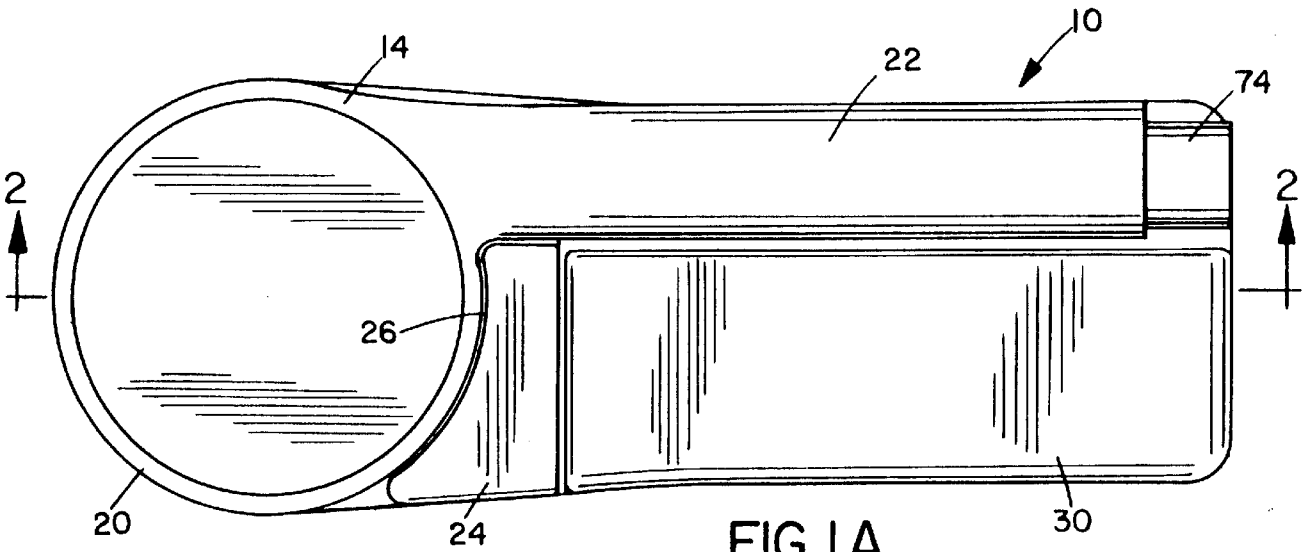
FIG. 1A is a top plan view of the rear of the phone of FIG. 1.
Figures 2, 2A, 2B, 2C, 2D, 2E, 2F, 2G:
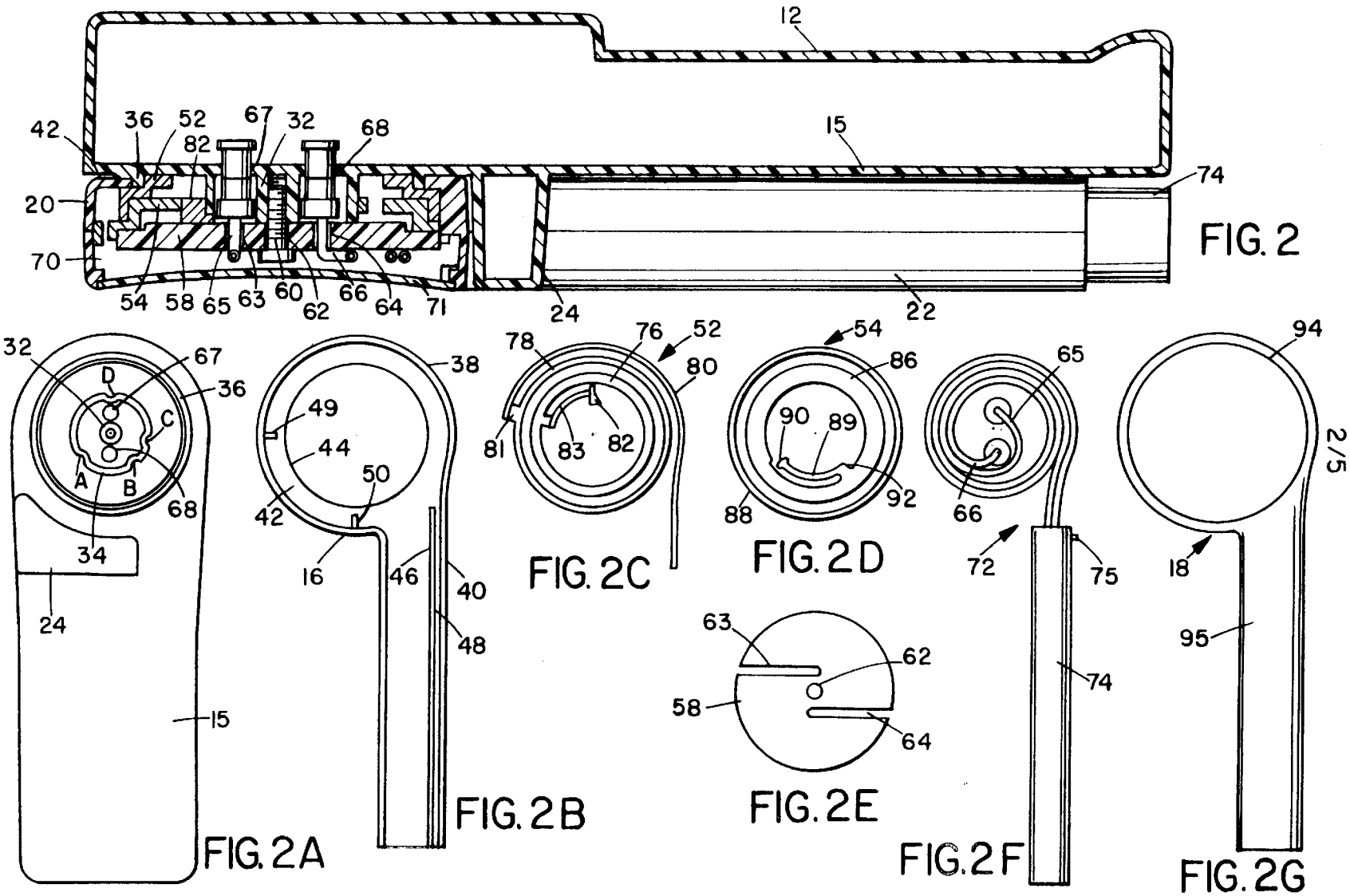
FIG. 2 is a cross section on the lines 2—2 of FIG. 1A with the battery removed.
FIG. 2A is a top plan view of the rear face of the phone housing at the base of the recess in which the antenna mechanism is mounted.
FIG. 2B is a top plan view of the base of the antenna housing.
FIG. 2C is a top plan view of the telescoping or actuating ring.
FIG. 2D is a top plan view of the detent ring.
FIG. 2E is a top plan view of a retention plate for retaining the telescoping ring, detent ring, and coiled antenna cables.
FIG. 2F is a top plan view of the dual band antenna assembly.
FIG. 2G is a top plan view of the cover of the antenna housing.

The antenna housing 14 is formed in two parts, as illustrated in FIGS. 2B and 2G, comprising a base 16 and a cover 18, which are secured together after the various antenna components and actuating devices illustrated in FIGS. 2C to 2F have been mounted within the base 16, as explained in more detail below. The housing 14 has a generally circular main body 20 and a tubular extension 22 projecting to one side of the main body, as best illustrated in FIGS. 1A, 2, 2B, and 3. The rear face or wall 15 of the phone housing has a projecting or dividing wall or baffle 24 projecting outwardly with an arcuate wall 26 defining part of a circular recess at one end of the rear face of the phone in which the circular main body 20 is rotatably mounted. A flat end face 28 of the baffle 24 forms a guide for the tubular extension 22 when in the storage position of FIG. 1A, so that the tubular extension lies along one side of the rear face of the housing, leaving a rectangular region in which the phone battery 30 is mounted, as indicated in FIGS. 1, 1A and 1B. The battery 30 is omitted from the rest of the drawings for clarity.

As best illustrated in FIGS. 2A and 4, the rear wall of the phone housing has a raised boss 32 projecting outwardly at the center of the circular recess in which the main body of the antenna housing is mounted, defining the pivot axis about which the antenna housing rotates. A raised ring 34 having a series of four, spaced, outwardly facing detents A,B,C, and D surrounds the boss 32. An outer annular rib 36 surrounds the ring 34.

The base 16 of the antenna housing is illustrated in FIGS. 2B and 3B, and has a circular portion 38 and a semi-cylindrical portion 40 projecting tangentially from the circular portion 38 to form half of the tubular extension 22. A lower wall 42 of the base has a central opening 44 for rotatable engagement over the annular rib 36 in the rear face of the phone housing when the parts are assembled as in FIG. 3B. A dividing wall 46 extending adjacent the outermost side of portion 40 forms a longitudinal slot 48 in the tubular extension. A pair of inwardly projecting tabs 49,50 project inwardly from the circular portion 38 of the base.

An antenna actuating or telescoping ring 52 and a detent ring 54 are each rotatably mounted in the base 16 over the boss 32, as best illustrated in FIGS. 2, 2C, 2D, 3C, and 3D. The detent ring 54 has an outer rim 56 secured to the base 16 via tabs 49,50 so that it rotates with the antenna housing. The telescoping ring 52 fits between the base 16 and the detent ring 54 and is not secured to either, so that the two rings 52,54 can rotate relative to one another.

A retention plate 58 is secured over the rings 52,54 with some free play via a bolt 60 or other suitable fastener. Bolt 60 extends through center opening 62 in plate 58 and is threadably engaged in a threaded bore in boss 32 on the rear wall of the phone housing. The opening 62 is of larger dimensions than the threaded shaft of bolt 60, so that the plate 58 can rotate with the antenna housing about bolt 60. Alternatively, non-threaded pins or fasteners can be used that are secured in place using a pressed fit, adhesives, or the like, as would be known. Plate 58 has a pair of oppositely directed slots 63,64 located above and below opening 62 respectively, through which cables 65,66, respectively, are directed. Cables 65,66 extend through openings 67,68, respectively, in the phone rear wall into the phone housing for connection to RF circuitry (not illustrated) within the housing, and outwardly into the chamber 70 between plate 58 and the outer end wall 71 of the main body 16, as indicated in FIG. 2.

The cables 65,66 form part of a dual band antenna assembly 72. The antenna assembly 72 is best illustrated in FIGS. 2F and 5, and comprises an elongate, cylindrical antenna element 74 telescopically mounted in the tubular housing extension 22, and the cables 65,66 which are coiled helically side-by-side in a clockspring fashion in the chamber 70 between plate 58 and end wall 71, which is arched inwardly as indicated in FIG. 2 to further constrain the cables. The cables are secured at their free ends to the inner end of antenna element 74. The antenna element 74 also has a small boss 75 adjacent its inner end.

The actuating or telescoping ring 52 will now be described in more detail. Ring 52 has an inner annular portion 76 and an outer annular portion 78. A resilient or flexible member 80 is secured via tab 81 to the outer annular portion 78 and extends around part of the periphery of annular portion 78, projecting away from ring 52 at its outer end. In a preferred embodiment flexible member 80 is a resilient plastic tape which has several advantages in terms of flexibility, non-conductivity, and ease of forming and interacting in a low friction manner with a guiding structure or slot as discussed below. However, those skilled in the art recognize that other flexible materials can be used, such as a metallic strip of steel, brass, certain composites, or other known material. In addition, other forms of material such as a flexible cable might be used in some applications. The projecting outer end of flexible member or tape 80 is secured to the boss 75 on the antenna element 74 and is located in slot 48 in the tubular extension 22 of the antenna housing, as best illustrated in FIGS. 3E and 3F. A two-level cam 82 is secured via arcuate extension 83 to the inner annular portion 76. The cam 82 has a lower portion 84 which is shaped for releasable engagement in the detent D of the raised ring 34 on the rear wall of the phone housing when the antenna housing is in the storage position, as illustrated in FIGS. 2, 3C, 4, and 4A. When the cam 82 engages in detent D, it is releasably connected to the phone housing and prevented from rotating.

The detent ring 54 also has an inner annular portion 86 and an outer annular portion 88. An arcuate extension 89 extends from the inside of inner annular portion 86 about part of its periphery and has a cam or tab 90 secured to its free end for successive, releasable engagement in the detents A,B,C, and D as the antenna housing is rotated, as will be explained in more detail below. Extension 89 also has a flat end face or cam face 92 which faces away from tab 90. When the detent ring 54 is engaged in the housing over telescoping ring 52, it will be oriented such that cam or tab 90 engages in the first detent A of the fixed ring 34, as indicated in FIG. 3D.

The cover 18 of the antenna housing has a circular portion 94 and a semi-cylindrical projection 95 which engage over the corresponding portions of the base 16. The assembly of the various components will now be described in more detail with reference to FIGS. 3A to 3F. FIG. 3A illustrates the rear wall 15 of the phone housing prior to assembly of the antenna housing onto rear wall 15. In the first step of FIG. 3B, the base 16 of the phone housing is rotatably engaged over the rim 36 of the phone rear wall, with the semi-cylindrical extension 40 extending away from the circular end portion along one side of the rear wall. The telescoping ring 52 is then engaged over the raised ring 34, with the cam portion 84 engaging in detent D and the free end of tape 80 engaging in slot 48, as illustrated in FIG. 3C.

At this point, the detent ring 54 is engaged over the top of ring 52 and housing ring 34, with ring 54 being oriented such that cam tab 90 engages in detent A of ring 34. The outer periphery 88 of ring 54 is suitably secured by welding, heat sealing, or other known fastening technique to tabs 49 and 50 of the base 16, as indicated in FIG. 3D. The retention plate 58 is then placed over ring 54, as illustrated in FIG. 3E, and secured in position via bolt 60. The antenna assembly is then mounted in the base, with the coiled portion of cables 65,66 located over plate 58. The cables extend inwardly through the respective slots 63,64 and openings 67,68 in the rear wall of the phone housing for suitable connection to circuitry in the housing in a manner which will be understood by those skilled in the field. The opposite ends of the cables are secured to the inner end of antenna element 74, which is positioned in the semi-cylindrical extension 40 of the base, as illustrated in FIG. 2F. The free end of the tape 80 is then secured to the small boss 75, or other appropriate connection element or point, on the antenna element. The cover 18 of the antenna housing is then placed over the entire assembly and suitably secured to the base 16 by heat welding, adhesive, or the like. The antenna mechanism is preferably of plastic material.

Operation of the antenna mechanism will now be described in more detail with reference to FIGS. 4 and 5. FIGS. 4 and 5A illustrate the antenna and housing in the storage position when the phone is not in use, with the cover, antenna assembly, and retention plate removed in FIG. 4 to reveal the relative positions of the telescoping and detent rings, and the cover only removed in FIG. 5A to reveal the position of the antenna element and coiled antenna cables when not in use. The RF cables 65 and 66 are represented by their center lines for clarity in FIGS. 5A to 5C. As best illustrated in FIG. 4, the two-level cam 82 on the telescoping ring is located in detent D on raised ring 34 in the phone rear wall, while the cam tab 90 is seated in the first detent A. In this position, the antenna element 74 lies along one side of the rear wall of the phone axis, with the longitudinal axis of element 74 extending parallel to the longitudinal axis of the phone (0° position). Thus, detent A corresponds to the storage position of the antenna and housing, or what is generally referred to as the 0° rotation position.

When a right-handed user wishes to use the phone, the tubular extension 22 is gripped and rotated anti-clockwise between the 0° position of FIG. 5A and a first use position, which is presented here as a 130° position of FIG. 5B. This angle or displacement is a common preferred angle for the position of the antenna relative to the axis of the phone housing. However, those skilled in the art will understand that other angles or detent positions can be used as desired by specific designs or in accordance with the anticipated use of the antenna without departing from the teachings of the invention. The angles discussed herein for user positions are preferred, but not physical limitations of the invention.

The rotation rotates the entire antenna housing along with detent ring 54 about the central axis defined by boss 32. The cam tab 90 is pulled out of detent A and rotates past detent B (which corresponds to a 90°, message receiving position of the antenna, typically used for hands free reception of paging messages and the like with the phone resting on a support surface.) and into detent C, which corresponds to the 130°, deployed position of FIG. 5B. In this position, the body of the phone can be placed against the right ear of the right-handed person with the antenna out of the way.

During this rotation, the telescoping ring 52 is attached to the phone rear housing via the two level cam 82 engaging in detent D, and is, therefore, held in position. This causes the tape 80 to push the antenna element 74 out of the tubular housing 22, as illustrated in FIG. 5B, so that the antenna element extends into the fully deployed position. At the same time, the coiled cables 65 and 66 are partially uncoiled to extend along the tubular housing as the element 74 extends.

As the detent ring is rotated from the 0° position to the 130° position, the end face 92 of arcuate extension 89 will engage the two-level cam 82. The arrangement is such that end face 92 engages cam 82 as the cam tab 90 engages in detent C. The end of cam 82 will engage in the indent or recess 96 at this point. If the antenna housing is rotated past the 130° position to the left-handed user position of FIG. 5C, corresponding to a 230° rotation of the housing, the end face 92 will push the two-level cam 82 out of detent D and will then urge the telescoping ring to rotate with the detent ring and antenna housing. Due to the change in engagement of the two-level cam, the telescoping ring is now effectively linked to the detent ring rather than the phone rear housing. Thus, the antenna element 74 is fixed in the fully extended position as the antenna housing continues to rotate up to the 230° deployed position of FIG. 5C, in which the phone can conveniently be used by a left-handed person. When the 230° position is reached, the cam tab 90 will engage in detent D. As in the case of the first user position, one or more alternative angles or detent positions can be employed as desired according to the anticipated use of the antenna.

The engagement of cam tab 90 successively in detents A, B, C, and D will releasably hold the antenna and housing in each of the storage, message, right-handed deployed, and left-handed deployed positions until positively urged by the user out of those positions. Upon reverse (clockwise) rotation of the antenna housing from the 230° position of FIG. 5C, the telescoping ring will first rotate with the detent ring due to the engagement of the cam 82 in indent 96. When the 130ϕ position is reached, the two- level cam 82 will again engage detent D of the raised ring 34 of the phone housing, and the telescoping ring is again locked in position. Further rotation of the antenna housing and detent ring will then cause tape 80 to pull the antenna element 74 back into the tubular extension 22, as indicated in FIG. 5A. At the same time, the cables 65,66 will be returned to the fully coiled position.

This arrangement, therefore, permits an antenna element to be automatically extended and retracted as the antenna housing is rotated between a storage and one or more deployed positions. The antenna mechanism operates to extend the antenna aperture past the end of the antenna housing in the first 90° of rotation. The antenna continues to extend to full height at 130ϕ of rotation, which is the right handed user position of FIG. 5B. The antenna remains fully extended during the next 100° of rotation, up to the left handed user position of FIG. 5C. The tape 80 which pushes and pulls on the antenna to accomplish the extension and retraction is constrained both in the radial direction and side-to-side. The radial constraint is provided by the inside diameter of the antenna housing and the outside diameter of the detent ring. The tape is constrained both side-to-side and vertically by the slot 48 in the tubular extension of the housing through which the end of the tape extends. Cable management is effectively managed through the clockspring arrangement of the cables with sufficient loop length to maintain an adequate bend radius for a large number of extension and retraction cycles, as illustrated in FIG. 5. This arrangement also keeps the cables separate and avoids entanglement during retraction, so that they coil back up into the configuration illustrated in FIG. 5A each time the antenna element is retracted. Preferably, the retention ring has a curved surface which supports the RF cables such that they do not exceed the minimum static cable bend radius, as illustrated in FIG. 2.

The antenna structure of this invention is small enough to be readily incorporated in portable or other hand-held applications, such as portable phones. The overall length when the antenna is retracted is the same as that of a portable phone housing, and the height or thickness is equivalent to that of the battery pack, such that the antenna structure does not increase the overall dimensions of the phone significantly. The antenna may be deployed quickly and easily for both right and left handed users.

Although a preferred embodiment of the invention has been described above by way of example only, it will be understood by those skilled in the field that modifications may be made to the disclosed embodiment without departing from the scope of the invention, which is defined by the appended claims.

What we claim as the invention is:

1. A deployable antenna for a wireless device, comprising:

an antenna housing rotatably mounted on said wireless device having a central axis about which it is rotatable, having a tubular extension from one side;

a telescoping antenna element mounted in said tubular extension so as to telescope in and out of said antenna housing so as to allow extension therefrom during deployment;

a detent ring mounted about said central axis within said antenna housing, having a detent body projecting therefrom for engaging detents extending from said wireless device, and being freely rotatable over a first predetermined angular displacement;

a telescoping ring positioned adjacent said detent ring and mounted about said central axis, and being freely rotatable over a second predetermined angular displacement; and a extension member connected on one end to said telescoping ring and on a second end to said antenna element for pushing or pulling against said element in response to rotation of said detent and telescoping rings within said housing.

2. The deployable antenna of claim 1 wherein said extension member comprises a flexible tape.

3. The deployable antenna of claim 2 further comprising a tape retention channel formed in said antenna housing so as to retain and guide said tape during deployment of said antenna.

4. The deployable antenna of claim 2 wherein said extension tape, detent ring, and telescoping ring are formed from a plastic material.

5. The deployable antenna of claim 1 further comprising a retention ring positioned adjacent said detent and telescoping rings for supporting and providing a predetermined amount of tension to electrical conductors connected to said antenna element through a clockspring type coiling of said conductors.

6. The deplorable antenna of claim 5 wherein said retention ring comprises a curved surface to prevent said conductors from exceeding a minimum static bend radius.

7. A wireless apparatus, comprising:

a first housing for enclosing wireless communication devices, the first housing having a central longitudinal axis and a rear wall;

a second, antenna housing rotatably mounted on the first housing for rotation about a first axis transverse to the central longitudinal axis of the first housing, the antenna housing being rotatable between a first, stored position alongside the first housing and at least one operative position at a predetermined angle to the first position;

the antenna housing having a main body portion and a tubular extension projecting from the main body portion;

a telescoping antenna element slidably mounted in the tubular extension for telescoping movement between a retracted position and an extended position extending a predetermined distance out of the tubular extension;

an actuating device for actuating the antenna element rotatably mounted in the main body of the antenna housing; and a flexible member having a first end secured to the actuating device and a second end secured to the antenna element, whereby rotation of the antenna housing from the first position to the operative position causes the antenna element to move from the retracted position to the extended position.

8. The apparatus as claimed in claim 7, wherein the flexible member comprises a flexible tape.

9. The apparatus as claimed in claim 8, wherein the actuating device has a cam, the rear wall of the first housing having a stop for engaging the cam to prevent rotation of the actuating device as the antenna housing rotates from the first position to the operative position, whereby rotation of the tubular extension and flexible tape through said predetermined angle causes the antenna element to extend into said extended position.

10. The apparatus as claimed in claim 9, wherein the actuating device comprises a disc.

11. The apparatus as claimed in claim 9, wherein the rear wall of the first housing has a raised ring, the ring having at least two spaced detents corresponding to said first and operative positions of said phone housing, and the actuator device further comprising a detent member rotatably mounted in said main body over said raised ring, the detent member being secured to the main body for rotation with the antenna housing, and having a cam tab for releasable engagement in said detents in the first and operative positions of said antenna housing, respectively.

12. The apparatus as claimed in claim 11, wherein the antenna housing is rotatable between a first operative position for right handed users and a second operative position for left handed users, the detent member having a biasing surface for forcing said actuator device cam over said stop to rotate with said antenna housing as said antenna housing rotates from said first operative position to said second operative position, whereby said antenna element remains in said extended position during rotation between said operative positions.

13. The apparatus as claimed in claim 12, wherein said raised ring has a third detent corresponding to said second operative position of said antenna housing, whereby said cam tab releasably engages said third detent when said antenna housing reaches said second operative position.

14. The apparatus as claimed in claim 7, wherein the first housing comprises a portable phone housing.

15. The apparatus as claimed in claim 7, including a pair of antenna cables extending from said first housing into the main body of the antenna housing, the cables being secured to the antenna element, the main body having a chamber for holding the cables, and the cables being coiled side-by-side in said chamber in a coiled configuration about said first axis, and extending from said coiled configuration into said tubular extension.

16. The apparatus as claimed in claim 15, including a retention plate in said main body extending over said actuator device, the main body having an outer end wall spaced from said retention plate to form said chamber, the first housing rear wall, actuator device, and retention plate forming at least two guide passageways for said antenna cables out of the first housing and into said cable retention chamber.

* * * * *